United States Patent [19]

Bower et al.

[11] Patent Number: 5,075,670

[45] Date of Patent: Dec. 24, 1991

[54] PERSONNEL MONITORING TAG WITH TAMPER DETECTION AND SECURE RESET

[75] Inventors: David S. Bower, Deerfield Beach; Ronald C. Davies, Ft. Lauderdale, both of Fla.

[73] Assignee: Digital Products Corporation, Ft. Lauderdale, Fla.

[21] Appl. No.: 561,443

[22] Filed: Aug. 1, 1990

[51] Int. Cl.[5] ..... G08B 21/00

[52] U.S. Cl. ..... 340/573; 340/539; 340/572

[58] Field of Search ..... 340/573, 539, 572

[56] References Cited

U.S. PATENT DOCUMENTS 3,806,874 4/1974 Ehrat ..... 380/23

4,747,120 5/1988 Foley ..... 379/38

4,792,796 12/1988 Bradshaw et al. ..... 340/573

4,885,571 12/1989 Pauley et al. ..... 340/573

4,924,211 5/1990 Davies ..... 340/573

4,980,671 12/1990 McCurdy ..... 340/573

*Primary Examiner*—Glen R. Swann, III

*Attorney, Agent, or Firm*—Cobrin, Feingertz & Gittes

[57] ABSTRACT

A signalling tag of the type used in house arrest systems has a tamper detection device for detecting removal of the tag from the monitored person. The signal is set to a tamper condition upon removal. The tamper detector can only be reset to the normal state by a reset signal which incorporates a characteristic of the signal sent by the tag. This provides enhanced protection against attempts by the monitored person to defeat the system through unauthorized resetting.

19 Claims, 4 Drawing Sheets

PERSONNEL MONITORING TAG WITH TAMPER DETECTION AND SECURE RESET

BACKGROUND OF THE INVENTION

The present invention relates to personnel monitoring systems and to components and methods useful in connection with such systems.

Automated systems have been developed for monitoring persons and verifying the presence of the monitored persons at specified locations. Using such systems, a person can be required to remain in his home or at some other specified location either continuously or during specified hours of the day. Such a requirement may be imposed as a punishment for crime or as a condition of probation, parole or other conditional release from incarceration. A sentence incorporating such a requirement may be employed either as an alternative to incarceration in a conventional jail or as an alternative to an ordinary parole or probation program. Such sentencing avoids the costs and adverse social effects associated with conventional incarceration but still provides effective control of the monitored persons.

Many personnel monitoring systems employ an encoded tag secured to each individual to be monitored. Each such tag may be equipped with a small, battery-powered radio transmitter arranged to broadcast an encoded, radio frequency tag signal. Ordinarily, the tag signal transmitter is switched on only during relatively brief, infrequent intervals such as for a few milliseconds every thirty seconds so as to send the tag signal only in discrete bursts or intervals. This conserves battery power and minimizes interference with other devices.

A receiver or monitoring unit adapted to receive the tag signals may be placed at each monitoring location. When the monitored person leaves the monitoring location, he takes the tag out of radio transmission range so that the monitoring unit no longer receives the tag signal. The monitoring unit thus can detect when the monitored person leaves his assigned location. Depending upon the system design, the monitoring unit can make a record of such departures for later retrieval or else can immediately notify a central monitoring station by sending an alarm signal via telephonic or other communications.

Such a system could be defeated if the monitored person were able to remove the tag from his person and depart from the monitoring location while leaving the tag behind. In that event, the monitoring unit would continue to receive the tag signal and hence, could not detect unauthorized absences of the monitored person. To preclude such cheating, tag signal transmitters typically have been secured to the monitored person by straps passing around the arm or leg of the person to be monitored so that the tag cannot be removed from the person's body without severing the strap. Various schemes have been devised for detecting severance of the strap or otherwise detecting removal of the tag from the person's body and altering the tag signal sent by the transmitter so as to indicate that tampering has occurred. A latch is provided having a normal state and a tamper state, and some sensing arrangement is arranged to trip the latch from its normal state to its tamper state upon tampering. The latch is arranged to remain in its tamper state after such triggering. The tag signal sending means or transmitter is arranged to send a normal tag signal when the latch is in its normal state, and to transmit a different "tamper" tag signal when the latch is in its tamper state. For example, in a multiple bit digital tag signal, one or more of the bits may be "tamper" bits having a first value in the normal signal and a second, different value in the tamper signal.

One scheme which has been utilized heretofore to detect tampering and to trip the tamper latch employs a conductor embedded in the strap which secures the tag transmitter to the monitored person. The conductor forms part of a severance detection circuit, and a small electrical current is continually passed through this circuit. The circuit is responsive to cessation of the current flow to trip the tamper latch into its tamper condition. Thus, if the strap is broken or removed from the tag transmitter, the circuit is interrupted and the latch is tripped to the tamper state. Systems of this sort are disclosed for example in U.S. Pat. Nos. 3,806,874 and 4,885,571.

These systems suffer from a fundamental drawback in that some means must be provided for resetting the tamper latch from its tamper state to its normal state after the tag has been fitted to the person to be monitored. The strap or other securement must be open when the device is initially fitted to the monitored person, so that the tamper latch ordinarily is in the tamper state or in another abnormal state when the device is first fitted to the monitored person. Thus, devices incorporating such a continuous current flow severance detection circuit may include a magnetic reed switch concealed within the housing of the tag and a circuit responsive to actuation of the reed switch to reset the tamper latch. Such systems have been susceptible to cheating by the monitored person. When the device is first fitted and an authorized person resets the tamper latch, the monitored person may observe the officer and deduce that a magnet is used to reset the tamper latch. Armed with that knowledge, the monitored person may be able to reset the tamper latch at will and hence may be able to remove the tag from his person and reset the tamper latch so that the tag continues to emit the normal tag signal.

Moreover, systems of this general design have been susceptible to cheating by short-circuiting the securement system conductor. Typically, the conductor in the strap or other securement device is connected to the remainder of the circuit by concealed terminals. It is difficult to insert a conventional metallic conductor into these terminals so as to "jump" the securement strap conductor. A determined individual may be able to establish a relatively high impedance, but nonetheless effective, electrical connection between these concealed terminals by immersing the entire tag in water or other conductive liquid. With that done, he may be able to sever or remove the securement strap and its conductor without tripping the tamper latch into the tamper state. The high impedance current pathway through the conductive liquid serves as a substitute for the conductor in the securement strap. With the small continuous current flow, the high impedance current path provided by the liquid may appear to be a closed circuit.

One system which avoids these drawbacks is taught in copending, commonly assigned U.S. patent application No. 07/200,088, filed May 27, 1988, and entitled, "Secure Personnel Monitoring System, " now abandoned and refiled as U.S. patent application Ser. No. 07/566,307. As set forth in the '088 application, the tamper detection circuitry of a personnel monitoring tag may incorporate a pair of conductors extending lengthwise along the strap or other securement device but electrically insulated from one another. An electrical potential may be continually applied between these two conductors, but without any current flow therebetween during normal operation. If an attempt is made to sever the strap, the conductors will contact one another, current will flow indicating the severance and tripping the tamper latch. The mechanical configuration of the securement strap and the tag housing may be selected so that the strap cannot be readily detached from the housing without destroying it and without establishing a circuit between the two conductors. In this arrangement, the tamper latch is not set to its tamper condition when the strap or other securement device is initially in an open, unjoined condition before attachment to the monitored person. Accordingly, there is no need to reset the tamper latch after attaching the device to the monitored person. The tag therefore need not incorporate any externally actuable resetting device. These features materially enhance the security of the system. Nonetheless, further improvement, beyond that afforded by the '088 application would be still more desirable.

The problems encountered in design of a personnel monitoring tag are magnified because of the severe cost constraints on such devices. Personnel monitoring tags are utilized in large numbers by governmental authorities, and cost is a significant consideration. Accordingly, there have been substantial, unmet needs for further improvements in personnel monitoring tags and in related devices and methods.

SUMMARY OF THE INVENTION

One aspect of the present invention provides a tag for use in a personnel monitoring system. A tag according to this aspect of the present invention incorporates tag signal means for sending a normal tag signal and sending a tamper tag signal different from said normal tag signal, the tamper tag signal having a predetermined characteristic. For example, the tamper tag signal may incorporate a predetermined code or may be sent only in discrete bursts or intervals, or both. The personnel monitoring tag according to this aspect of the invention preferably also includes tamper latch means having a normal state and a tamper state, the tag signal means being arranged to send the normal tag signal when the tamper latch means is in the normal state and to send the tamper tag signal when the tamper latch means is in the tamper state. The tag further incorporates securement means for securing the tag signal means to a person to be monitored and tamper detection means for detecting detachment of the tag signal means from the person to be monitored and placing the tamper latch means in the tamper state in response to such detachment. Most preferably, the tag incorporates reset means for resetting the tamper latch means to its normal state only in response to a reset signal corresponding to a predetermined characteristic of the tamper tag signal. In this arrangement, the reset means can be actuated so as to reset the tamper latch means to its normal state by receiving the tag signal so as to determine the predetermined characteristic of the tag signal and producing a reset signal corresponding to that predetermined characteristic. Most preferably, the tag signal means is arranged to send the tamper tag signal only during discrete, timed intervals and the reset means is arranged to reset the tamper latch means only in response to a reset signal bearing a predetermined time relationship with the intervals of the tag signal. For example, the reset means may be arranged to reset the tamper latch means only in response to a reset signal which commences during one of the intervals of the tamper tag signal.

Tags according to this aspect of the present invention provide excellent security against unauthorized resetting. Unless the monitored individual knows that he must duplicate the characteristic of the tag signal, such as its timing, in the reset signal, it is unlikely that he would succeed in guessing the proper reset signal or in applying a reset signal which accurately duplicates the characteristic of the tamper tag signal. Moreover, nothing in the normal, authorized resetting operation performed by a monitoring officer after the tag is first attached to the monitored person will reveal to the monitored person that the resetting operation depends upon receiving the tag signal and duplicating its characteristic in the reset signal. Further, these benefits can be achieved at an extremely low cost.

Ordinarily, the tag signal means included in a personnel monitoring tag is powered by a potential source arranged to provide a first potential at predetermined intervals and to provide a second potential, ordinarily a ground potential, different from the first potential except during those intervals. The transmitter is connected to such a potential source and is arranged to transmit tag signals, such as the normal and tamper tag signals in response to application of the first potential. The reset means preferably includes signal storage means for storing a first signal responsive to application of the first potential and a second signal responsive to application of the second potential. The reset means may further include switch means for connecting the signal storage means to the potential source means except during application of a reset signal and for disconnecting the signal storage means from the potential source means and connecting the signal storage means to the tamper latch means during application of the reset signal. The tamper latch means preferably is settable to the normal state upon application of the first signal to the tamper latch means by the signal storage means.

In this arrangement, the signal storage means will store the second signal except during the intervals when the first potential is applied and the transmitter is sending a tag signal. Thus, the signal storage means will apply the first signal to the tamper latch means only if the reset signal is commenced during one of these intervals. The signal storage means may be as simple as an ordinary capacitor which stores whatever potential is applied to it by the potential source means. The switch means desirably includes a magnetically actuatable switch. When a magnetically actuatable switch is employed in the preferred arrangements according to the present invention, the tamper latch means cannot be reset unless the magnetic field application is commenced during one of the transmission intervals. The probability of a monitored person doing this is extremely low. Typically, the transmission intervals amount to only a small fraction of the total time.

The switched potential source ordinarily is provided in the tag for the purpose of conserving power. In the preferred tags according to this aspect of the present invention, the switched potential and the inherent timing signal incorporated in the potential switching are used for the additional purpose of providing greatly enhanced security against unauthorized resetting. The only additional circuit element needed to provide this increased security is the storage means, which may be as simple as a capacitor, and the appropriate circuit interconnections. Thus, tags according to this aspect of the present invention can be essentially as economical as conventional tags which include a simple magnetically actuated resetting switch without the enhanced security afforded by the present invention.

A further aspect of the present invention provides a resetting tool for authorized resetting of a personnel monitoring tag. A tool according to this aspect of the present invention preferably includes means for receiving a tag signal from the personnel monitoring tag, means for determining a predetermined characteristic of the tag signal and means for generating a reset signal so that the reset signal matches a predetermined characteristic of the tag signal and applying that reset signal to the tag. Preferably, the means for determining a characteristic of the received tag signal includes means for determining when the tag signal is being received, and the means for generating a reset signal includes means for generating the reset signal in predetermined time relationship to reception of the tag signal. The means for generating the reset signal may include means for generating the reset signal only while the tag signal is being received. Preferably, this apparatus is arranged to delay commencement of the reset signal until a predetermined delay time has elapsed after reception of the tag signal has commenced. The means for generating the reset signal may include means such as an electromagnet for generating a magnetic field and applying that magnetic field to the personnel monitoring tag. A tool according to this aspect of the present invention can be used by an authorized officer to reset a tag as discussed above.

A further aspect of the present invention provides a personnel monitoring tag with enhanced tamper detecting means. A tag according to this aspect of the present invention preferably includes tag signal means for sending a tag signal, reference means for providing a source of a reference potential, which may be a ground potential, and switching potential source means for providing a potential alternating between first and second potentials, at least one of the first and second potentials being different from the reference potential. The tag preferably also includes tamper latch means having a normal state and a tamper state. The tag signal means is arranged to send a normal tag signal when the tamper latch means is in its normal state and to send a tamper tag signal when the tamper latch means is in its tamper state. The tamper latch means most preferably has a trip input and is responsive to change from the normal state to the tamper state upon application to the trip input of a trip potential different from the reference potential. The tag further may incorporate securement means for securing the tag signal means to a person to be monitored and connection means for electrically connecting the trip input to the reference potential through the securement means so that the connection will be broken if the securement means is disrupted. Most preferably, the tag also includes a capacitor, the trip input of the tamper latch means being connected to the alternating potential source means through the capacitor. If the connection between the trip input of the tamper latch and the reference potential through the securement means is broken, the alternating potential applied by the alternating potential source means will be applied to the trip input and the tamper latch will be set to the tamper state. This will occur even if a relatively high impedance connection remains between the trip input and the reference potential source as, for example, where the monitored person attempts to break or remove the securement means while holding the tag under water.

The tamper detection circuit according to this aspect of the present invention can distinguish relatively small changes in the impedance of the connection between the trip input and the reference potential. By contrast, circuits utilized heretofore relying only on constant current flow through the connection may be incapable of distinguishing between the low impedance of the normal connection and a high impedance current pathway such as that found in an underwater environment with the securement means broken. Attempts to enhance the sensitivity of the constant current DC system by increasing the current flow are limited by considerations of battery life. By contrast, the alternating potential system according to this aspect of the present invention operates only intermittently, and only with minimal current flow as set by the characteristics of the capacitor. It can therefore provide excellent sensitivity with minimal power consumption. The DC, constant current flow system may be used in addition to the alternating potential system according to this aspect of the invention to provide still further security. Here again, the added cost incurred for the additional security is minimal, because the system may use the switched potential source typically incorporated in the tag to power the tag signal transmitter at intervals.

These and other objects, features and advantages of the present invention will be more readily apparent from the detailed description of the preferred embodiments set forth below, taken in conjunction with the accompanying drawings.

Figure 1:
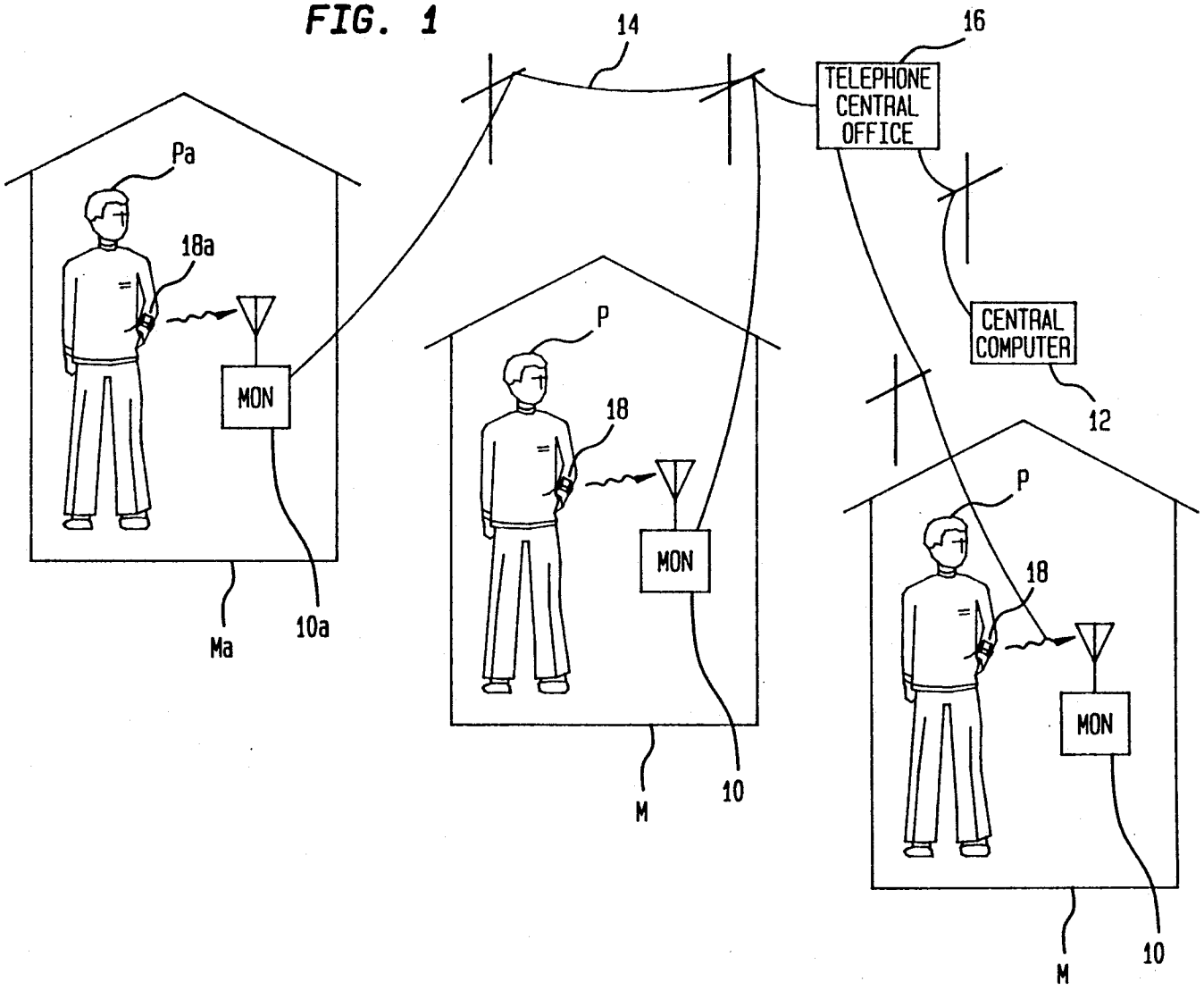
FIG. 1 is a diagrammatic view depicting the overall organization of a personnel monitoring system employing apparatus in accordance with the present invention.

DETAILED DESCRIPTION OF THE PREFERRED EMBODIMENTS:

A personnel monitoring system in accordance with one embodiment of the invention is arranged to monitor the presence or absence of a persons P at a plurality of monitoring locations M. In a typical parolee monitoring program, each monitoring location may be the home of a parolee. Each monitoring location is provided with a monitoring unit 10 incorporating a radio receiver adapted to receive a radio signal bearing a multi-bit address code and also bearing a so-called "toggle" bit and a so-called tamper bit. The address code used by each receiver is different, so that each receiver will only accept signals bearing the correct address code. Each monitoring unit 10 is arranged to communicate with the monitoring authority. In the arrangement shown in FIG. 1, each monitoring unit 10 is arranged to communicate with a central computer 12 operated by the monitoring authority through ordinary telephone lines 14 and through a community telephone exchange 16. Other means of communication, such as radio communication, may be employed to link the monitoring units to the monitoring authority. In one particularly useful arrangement, described in copending, commonly assigned U.S. Pat. No. 4,924,211, dated May 8, 1990, each monitoring unit may be arranged to send a radio signal in response to an interrogation signal, so that the various monitoring units may be interrogated seriatim by a monitoring officer traveling to the vicinity of each monitoring unit, such as by driving an automobile equipped with appropriate radio equipment pas the various locations.

A tag 18 is provided for each monitored person. Each tag 18 incorporates a housing 20 (FIG. 2) and a strap 22 for securing the housing to the wrist or ankle of the monitored person. When the tag is first placed in operation, the monitoring officer fastens housing 20 to the wrist or ankle of the person to be monitored by placing the strap 22 tightly around the wrist or ankle and fastening the strap to the housing, as with rivets 24, 26 and 28, so that the housing cannot be removed from the person's wrist or ankle without detaching the strap from the housing or severing the strap. Strap 22 is provided with a pair of elongated electrical conductors such as foil strips or wires 30 and 32 extending lengthwise along the strap. These conductors extend generally parallel to one another and in close proximity to one another, but are electrically insulated from one another. Conductor 30 is electrically connected to a terminal 34 at a first end of the strap, but the end of conductor 30 at the opposite end of the strap is not connected to any terminal. Conductor 32 is electrically connected to a terminal 36 at the first end of the strap and to a further terminal 38 at the opposite end of the strap.

A sensing and radio signaling circuit 40 is disposed within housing 20. As further discussed below, circuit 40 sends radio frequency signals, referred to herein as "tag" signals at predetermined intervals. Each such signal bears a predetermined address code. The code used by the transmitter unit 40 in each tag 18 is selected to match the address code used by the monitor at the associated location. For example, tag 18*a* (FIG. 1) is provided to the particular person $P_a$ assigned to monitoring location $M_a$ and hence, tag 18*a* uses the same address code as monitoring unit 10*a* positioned at that monitoring location.

So long as each monitored person remains at his assigned location, the monitoring unit will continually receive the tag signals as the same are sent by the tag worn by that person. However, if a monitored person leaves his assigned monitoring location, the monitoring unit 10 at his location will no longer receive the tag signal. The monitoring unit 10 may be arranged to record this absence and the times thereof for subsequent retrieval by the monitoring authorities, or to send an appropriate alarm signal to the monitoring authorities as via the telephone lines 14 immediately upon such absence, or both. The system thus relies upon reception of the tag signals via the monitoring unit as indicating that the monitored person is present at a particular monitored location. The monitored person may attempt to defeat the system either by providing an additional radio transmitter set to provide a replica of the tag signal or by removing the tag from his body and leaving the tag at the monitoring location while he leaves that location period.

Each radio transmitter unit is also arranged to send a so-called "change" or "toggle" bit. The value of this bit changes according to a predetermined pattern with time. Preferably, the value of this bit changes in every succeeding transmission interval. The monitoring unit is arranged to check the transmissions as the same are received and to determine whether the value of the change bit is changing in accordance with the predetermined pattern variation. As further disclosed in copending commonly assigned U.S. patent application Ser. No. 07/200,088, such a change bit provides greatly increased protection against attempts to duplicate the signal from the tag.

The circuit 40 in each tag 18 is also arranged to detect severance or removal of strap 22 as discussed below, and thereby detect removal of the tag from the monitored person's body. The circuit is arranged to send the normal tag signals so long as no attempt to sever or disconnect the strap is detected, and to send different, so-called "tamper" tag signals after any such attempt is detected. Preferably, the circuit 40 in each tag is arranged to incorporate a "tamper" bit in each tag signal. This tamper bit has a normal value in each normal tag signal and has a tamper value different from the normal value, in each tamper tag signal.

Each monitoring unit 10 is arranged to detect the tamper signal and to make an appropriate record for subsequent retrieval and/or issue an appropriate alarm signal upon receipt of the tamper signal. Thus, if the monitored person attempts to move the tag from his body, the central monitoring authority will be informed.

Figure 4:
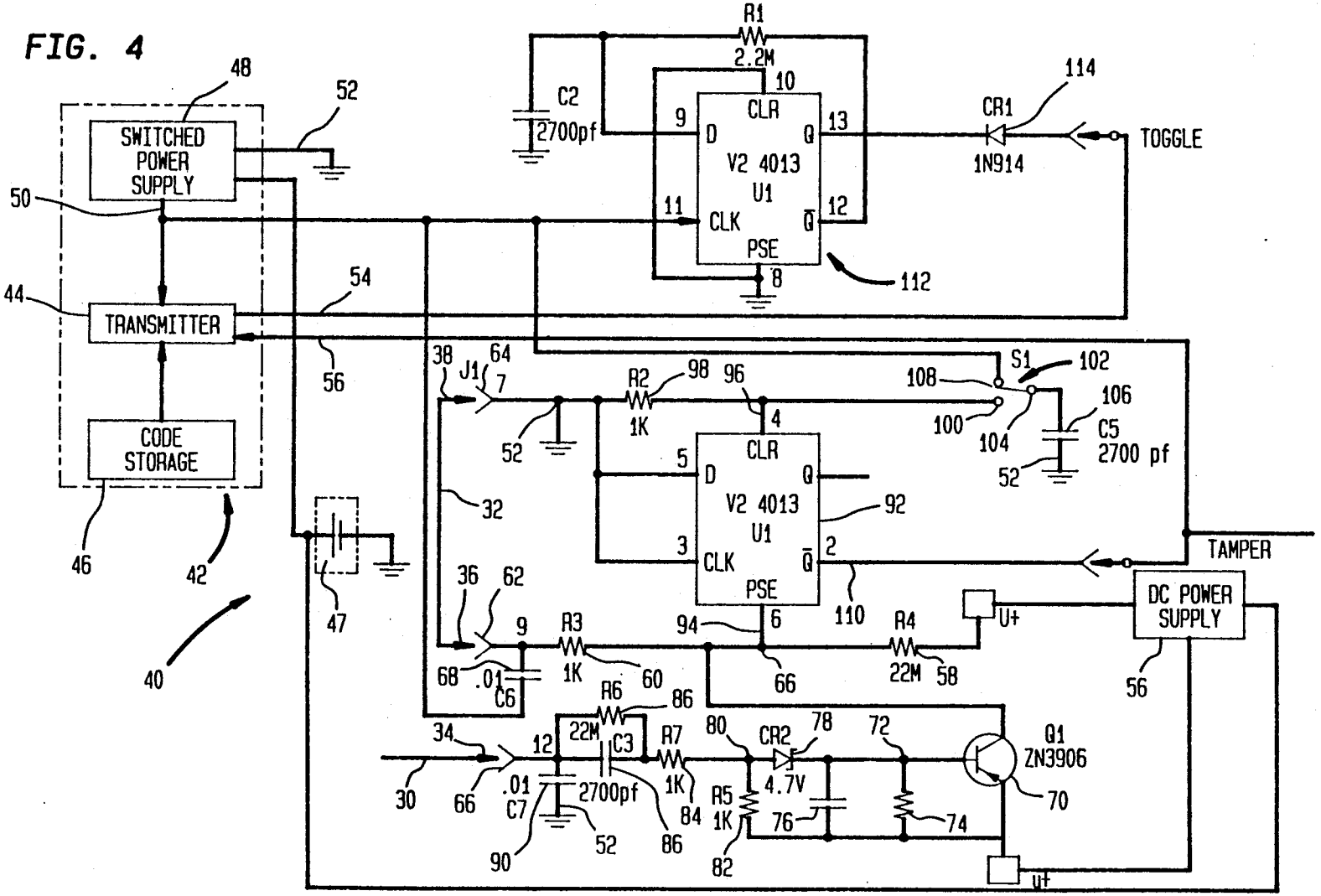
FIG. 4 is an electrical circuit diagram of the tag of FIG. 2.

The circuit 40 incorporated in each tag and disposed in housing 20 is schematically depicted in FIG. 4. Circuit 40 incorporates a commercially available radio signaling unit 42. Unit 42 includes a radio transmitter 44 and a code storage unit 46 storing the predetermined address code for that particular tag. Unit 42 also includes a switched power supply 48. A battery 47 is disposed within housing 20. Power supply 48 is arranged to draw electrical energy from battery 47.

Power supply 48 has a power output connection 50 connected to transmitter 44. Power supply 48 is connected to a local ground or reference voltage bus 52 within housing 20. Power supply 48 is arranged to time predetermined transmission intervals, preferably about three milliseconds long and predetermined dwell intervals, preferably about thirty-five seconds long in alternating sequence, so that each transmission interval is separated from the next succeeding transmission interval by one dwell interval. Power supply 48 is arranged to maintain its power output connection 50 at the ground or reference potential provided by bus 52 during each dwell interval, and to apply a preselected high or positive potential on output connection 50 during each transmission interval.

Transmitter 44 is powered by power supply 48. Thus, when power supply 48 applies the high potential at output 50, transmitter 44 operates to send a radio signal. When power supply 48 applies the ground or reference potential at output 50, transmitter 44 is quiescent and does not send. Transmitter 44 is arranged to send a radio signal bearing a set of address bits corresponding to the information stored in code storage unit 46, and also bearing a toggle bit and a tamper bit. The transmitter is arranged to provide a "one" or "zero" value to the toggle bit in the transmitted signal depending upon the potential on input line 54, and to provide a one or a zero value to the tamper bit in the transmitted signal depending upon the potential on input line 56.

Figure 2:
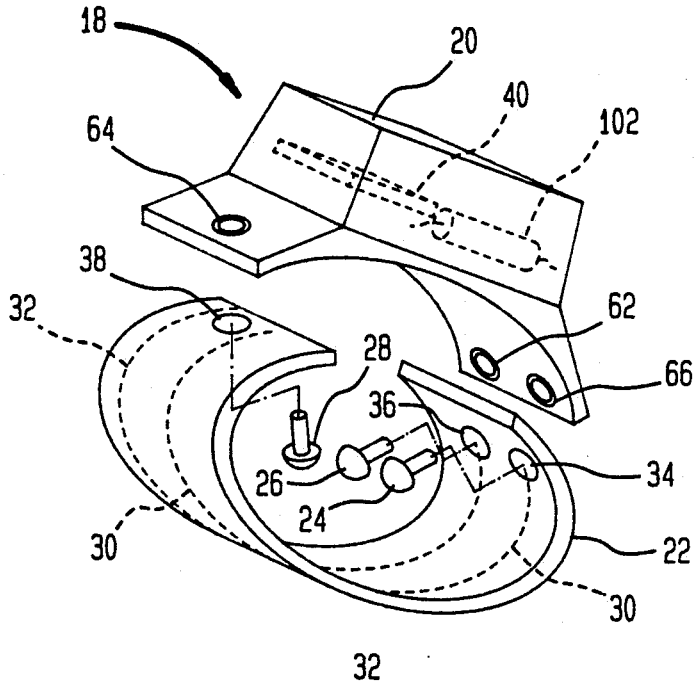
FIG. 2 is a schematic perspective view of a personnel monitoring tag in accordance with one embodiment of the invention.

A DC power supply 56 is provided for drawing electrical energy from battery 47 and providing a substantially constant, regulated high potential. A high impedance resistor 58 and a low impedance resistor 60 are connected in series between the output of power supply 56 and a terminal 62. Terminal 62 in turn is connected to terminal 36 of the strap 22 (FIG. 2). A further terminal 64 is connected to the ground or reference potential bus 52 of the tag and to the terminal 38 on strap 22, so that terminals 62 and 64 are interconnected by conductor 32 of the strap while the strap is in its normal, undisturbed condition. Resistors 58 and 60 form a voltage-dividing network. Because the value or impedance of resistor 58 is far higher than that of resistor 60, the voltage at circuit node 67, between the resistors, will be approximately equal to the ground or reference voltage, and the current flow through this voltage dividing network will be extremely small, on the order of microamperes.

A capacitor 68 is connected between the output 50 of switched power supply 48 and terminal 62. Thus, the high potential applied by power supply 50 is applied to one side of capacitor 68 during the transmission intervals. With the circuit in the normal, undisturbed condition illustrated, conductor 32 provides a low impedance connection between terminal 62 and the reference or ground potential source 52. In this condition, the periodic application of a high potential on one side of capacitor 68 does not appreciably raise the voltage at circuit node 67. Capacitor 68 effectively blocks current flow from the switched power supply to ground through conductor 32.

Circuit 40 further includes a PNP transistor 70 having its emitter connected to the output of DC power supply 56 and its collector connected to circuit node 67. The base of transistor 70 is connected to a circuit node 72. A resistor 74 and capacitor 76 are connected in parallel between DC power supply 56 and node 72. A zener diode 78 is connected between node 72 and a further circuit node 80. Node 80 in turn is connected to DC power supply 56 through a resistor 82 and to a terminal 66 through a further resistor 84 in series with a parallel connected resistor 86 and capacitor 88. Terminal 66 is also connected to the ground or reference potential 52 through a capacitor 90. Terminal 66 is connected to the terminal 34 of conductor 30 in strap 22 (FIG. 2). In the condition illustrated in FIG. 4, conductor 30, and hence, terminal 66, are open circuited. The voltage at circuit nodes 80 and 72 becomes equal to the voltage supplied by power supply 56. In this condition, the emitter/collector impedance of transistor 70 is extremely high. Any current passing through transistor 70 to node 67 is so small that it does not appreciably raise the voltage at node 67.

A tamper latch or flip-flop 92 is also provided. The tamper flip-flop 92 has its PREinput 94 connected directly to circuit node 67 and its clear or reset input 96 connected to ground or reference potential 52 through reset resistor 98. The reset or clear input 96 of flip-flop 92 is also connected to a side terminal 100 of a single pole, double throw magnetically-actuatable switch 102. The center terminal 104 of switch 102 is connected to one side of a capacitor 106. The opposite side of this capacitor is connected to the ground or reference potential 52. The second side terminal 108 of switch 102 is connected to the output 50 of switched power supply 48. Switch 102 is normally biased to the position illustrated in FIG. 4 with center terminal 104, and hence, capacitor 106 connected to second side terminal 108, and hence, to the output 50 of switch power supply 48. The $\overline{Q}$ output 110 of flip-flop 92 is connected to the tamper input 56 of transmitter 44. The D and CLK inputs of flip-flop 92 are connected to ground or reference 52, whereas, the Q output is open-circuited. Flip-flop 92 is arranged to change the signal at the $\overline{Q}$ output supplied to input 56 of the transmitter from one (indicating a normal state) to a zero (indicating a tamper state) upon application of a high voltage, above a predetermined threshold, typically about +4.0 volts at the PRE or trip input 94. Flip-flop 92 is arranged to change the output at $\overline{Q}$ back to its normal state or one upon application of a high voltage, also above about 4 volts, at CLR or reset input 96.

Circuit 40 further includes a toggle flip-flop 112 and an associated resistor and capacitor. The CLK input of flip-flop 112 is connected to the output of power supply 50, whereas, the Q output of flip-flop 112 is connected through a diode 114 to the toggle bit input 54 of transmitter 44. Flip-flop 112 is arranged to change the digital value appearing at Q output and at toggle bit input 54 from a 1 to a 0 on each cycle of power supply 48, i.e., each time power supply 48 switches the voltage at output 50 from the high voltage to the ground or reference voltage. Thus, after each transmission interval, the input applied at line 54 changes either from 1 to 0, or from 0 to 1, so that a different value is supplied during the next succeeding transmission interval.

With the circuit in the condition shown, and assuming that the $\overline{Q}$ output of tamper flip-flop 92 is initially set to the digital high or normal state, the transmitter 44 will send a normal tag signal during each transmission interval. Each such tag signal will include the code stored in code storage unit 46, a tamper bit indicating that the tamper flip-flop 92 is in its normal state and a toggle bit. The value of the toggle bit will depend upon the signal applied at input 54. That signal, and hence the value of the toggle bit, changes after each transmission interval.

If the monitored person attempts to remove or sever strap 22 (FIG. 2), he will ordinarily sever or disconnect conductor 32. In that event, terminal 62 is open-circuited, and hence, the voltage at node 66 rises to the voltage supplied by power supply 56, thus bringing the voltage at node 67, and hence, at trip input 94 of flip-flop 92 above the predetermined threshold. The $\overline{Q}$ output of flip-flop 92 will change from 1 to 0, and the input at the tamper input 56 of transmitter 44 will likewise change. After this change, transmitter 44 will incorporate a value for the tamper bit indicating that tampering has occurred. Thus, on each subsequent transmission interval, transmitter 44 will send a tamper signal similar to the normal signal but having a different value for the tamper bit. In the tamper signal, as in the normal signal, the value of the toggle bit will change after each transmission interval. The monitoring unit 10 (FIG. 1) at the associated monitoring location will recognize the signal as being a tamper signal by virtue of the tamper bit value and will make an appropriate record or send the appropriate alarm signal to the central monitoring authority.

The monitored person may attempt to defeat the system by immersing the tag in water or another conductive liquid before severing or detaching the strap. This will establish a relatively high impedance connection between terminals 62 and 64, in parallel with conductor 32. With this high impedance connection in place, the impedance from node 67 to ground or reference connection 52, may be considerably less than the impedance of resistor 58, even when conductor 32 is removed. In that event, the voltage at node 67 and at trip input 94 may not rise above the threshold needed to trip flip-flop 92 when conductor 32 is severed. However, on the next succeeding transmission interval, when a substantial positive voltage is applied to capacitor 68 by power supply 48, the voltage at node 67 will rise above the threshold, and hence, the tamper latch or flip-flop 92 will be set to its tamper condition.

If the monitored person attempts to sever the strap, rather than to remove it, he will ordinarily bring conductor 30 into electrical contact with conductor 32. This establishes a low impedance connection between terminal 66 and terminal 64, thus discharging capacitor 88 to the ground or reference potential at connection 52. The voltage at node 80 will momentarily fall below the voltage at node 72 by an amount greater than the threshold or breakdown voltage of zener diode 78, thus causing zener diode 78 to become conducting, whereupon, the voltage at node 72 will drop below the voltage supplied by DC power supply 56 and transistor 70 will turn on. That is, the emitter to collector impedance of transistor 70 will fall essentially to zero, thus connecting node 67 substantially to the full voltage of the power supply 56 and raising voltage at the trip input 94 of the flip-flop 92 above the required threshold. In this event also, the flip-flop 92 will be reset from the normal condition to the tamper condition and the tamper bit in the subsequent signals sent by transmitter 44 will change from normal to tamper. Zener diode 78, in conjunction with capacitor 86 and capacitor 76, assures that transistor 70 will not be turned on if only a high impedance connection is established between terminal 66 and terminal 64. In this event, some small current flow may occur between these terminals, but the voltage at node 80 will be only slightly below the voltage at node 72. The difference between these voltages will not be sufficient to cause zener diode 78 to go into conduction mode, and hence, the voltage at node 72 will remain substantially equal to the voltage applied by power supply 56. Transistor 70 will remain substantially nonconducting between its base, and the emitter, and hence, the voltage at node 67 will not be substantially increased. Thus, if a high impedance connection is accidentally established between terminal 66 and terminal 64, the tag will not be set into its tamper condition as a result.

During operation of the tags with switch 102 in the position shown, the voltage appearing at the center terminal 104 of switch 102 at any given time will be the same as the voltage applied at output 50 by switched power supply 48. During each transmission interval, this voltage will increase to the high potential. Desirably, the value of capacitor 106 and the characteristics of power supply 48 are selected so that capacitor 106 changes substantially to the high potential in about 1 millisecond after commencement of each transmission interval. Between transmission intervals, this voltage at terminal 104 will be the reference or ground voltage.

When the tag is initially fitted to a person to be monitored, strap 22 necessarily is disconnected from housing 20, and hence, from the terminal or terminals at one end of the strap. While the tag is being fitted to the monitored person, the voltage at node 67, and hence at the trip input 94 of flip-flop 92 will be above the threshold voltage required to trip the flip-flop into its tamper state. After the tag has been fastened to the monitored person, and strap 20 is securely connected to housing 40 at both ends of the strap and electrically connected to terminals 62, 66 and 64, the tamper flip-flop 92 must be reset to its normal state. This can be accomplished by applying a reset signal in the form of a magnetic flux to magnetically actuable switch 102 during one of the transmission intervals, so as to connect center terminal 104, and hence, capacitor 106, to terminal 100, and hence, to the reset input 96 of flip-flop 92. It should be clearly understood that the tamper flip-flop 92 will only be reset if switch 102 is thrown during one of the transmission intervals. The voltage at terminal 104 (the voltage stored on capacitor 106) will be high only during the transmission intervals, when capacitor 106 is charged. During the dwell intervals between transmission intervals, the capacitor 106 is discharged. Thus, any attempt to reset the flip-flop by throwing switch 102 during a dwell interval would have no effect. Stated another way, the magnetic reset signal to throw switch 102 must be commenced after commencement of a transmission interval and after capacitor 106 is changed.

Figure 3:
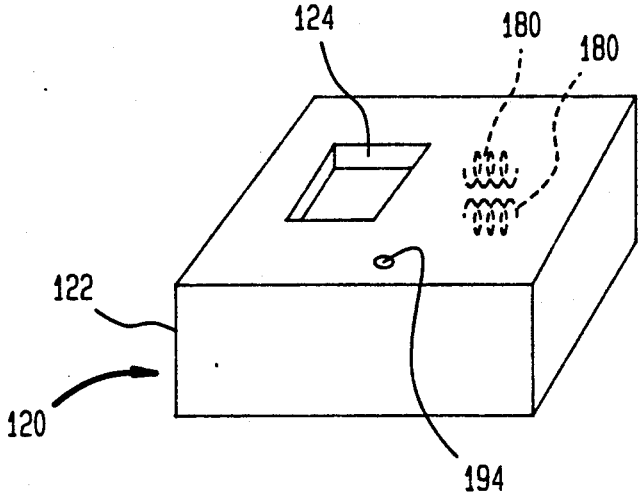
FIG. 3 is a schematic perspective view of a tool in accordance one embodiment of the invention for resetting the tag of FIG. 2.
Figure 5:
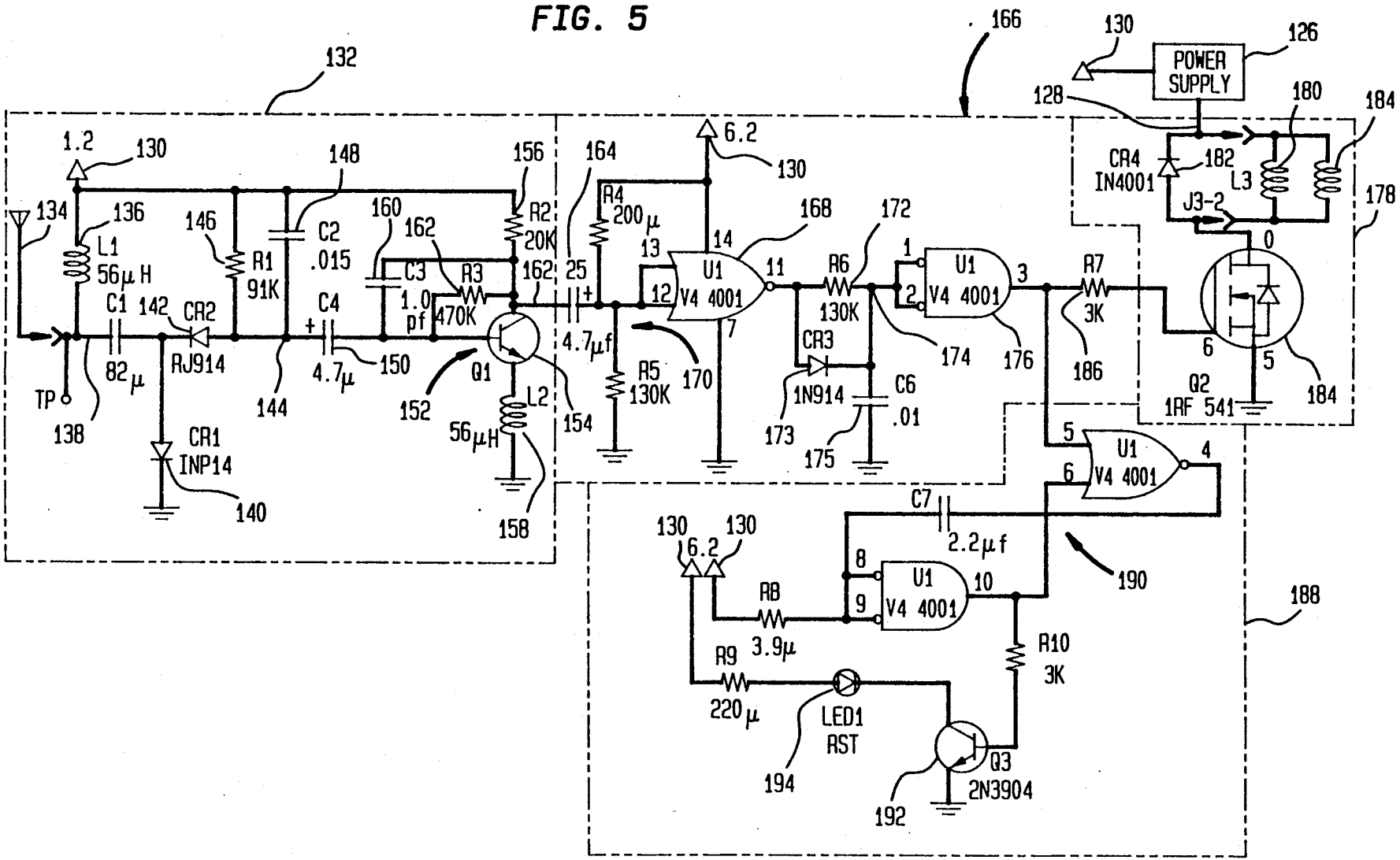
FIG. 5 is an electrical circuit diagram of the tool of FIG. 3.

To permit authorized resetting by a monitoring officer, a resetting tool 120 (FIG. 3) is provided at the office of the monitoring organization. Resetting tool 120 has a housing 122 with a depression 124 on one surface adapted to receive the housing 20 of a tag. A circuit as illustrated in FIG. 5 is disposed within housing 122. This circuit incorporates a power supply 126 arranged to provide a solenoid drive voltage, preferably about 12 volts, on a solenoid drive output 128 and to provide regulated component operating voltage, preferably about 6.2 volts, at various power supply connections 130 throughout the circuit. The circuit of the resetting tool includes a crystal radio receiver 132. Receiver 132 includes an antenna 134 connected to an inductor 136 and capacitor 138, inductor 136 being connected between the antenna and a power supply connection 130. A diode 140 is connected between capacitor 138 and ground, whereas a second so-called "pump" diode 142 is connected between this capacitor and a circuit node 144. Node 144 is connected through a resistor 146 and capacitor 148 in parallel to operating voltage source 130. Diodes 140 and 142 are silicon diodes. Both are forwardly biased by the component operating voltage applied at source 130 and transmitted through resistor 146. Radio frequency ("RF") signals in the frequency range utilized by transmitter 44 (FIG. 4) impinging on antenna 134 will induce corresponding RF voltages in inductor 136. These voltages are rectified by diodes 140 and 142. Negative excursions of the RF voltage signal on 136 are passed by diode 142, whereas, positive excursions of the signal are passed by diode 140. This combined action charges or "pumps" capacitor 148 to a negative charge, i.e., so that a negative potential appears at node 144. Leakage through resistor 146 tends to dissipate this negative potential gradually. Thus, the negative potential appearing at node 144 represents the amplitude of radio frequency signals received at antenna 134.

Node 144 is coupled through a capacitor 150 to the input of a stabilized transistor output amplifier 152. Output amplifier 152 includes an NPN transistor 154 having its collector connected to operating voltage source 130 through a resistor 156 and its emitter connected to ground through an inductor 158. A capacitor 160 and resistor 162 are connected in parallel between the base and the collector of transistor 154. A capacitor 150 constituting the input connection to the amplifier, is connected between the base of the transistor and receiver output node 144. Capacitor 160 provides negative feedback for extremely short duration pulses, shorter than about 1 millisecond whereas inductor 158 reduces the sensitivity of the amplifier to RF signals impinging directly on the amplifier. The output connection 162 of the amplifier 152 is connected to the collector of transistor 154. The amplifier provides, at output connection 162, an inverted, amplified replica of the signal supplied through input capacitor 150.

The output 162 of the receiver amplifier 152 is coupled through a capacitor 164 to the input of a gating and timing circuit 166. Circuit 166 includes an inverting OR gate 168 having its input connected to capacitor 164 and also connected to a voltage dividing resistor network 170. Network 170 is connected between an operating voltage source 130 and ground, and applies a bias voltage to the inputs of gate 160, holding the output of the gate normally high or logic "1". The output of gate 168 is connected through a resistor 172 in parallel with a diode 173 to a circuit node 174, which node is also connected via a capacitor 175 to ground. Resistor 172, diode 173 and capacitor 175 form a slow attack, fast delay network. When the output of gate 168 goes low or negative, the voltage at 174 will follow slowly, due to the delay in charging capacitor 175. However, when the output of gate 168 goes high or positive, the voltage at node 174 will follow almost immediately, because diode 173 effectively short-circuits resistor 172. Node 174 is connected to a further gate 176 serving as an inverter.

The circuit of the resetting tool further includes a solenoid output and switching section 178. Section 178 incorporates a pair of solenoids 180 connected in parallel with one another and in parallel with a protective diode 182 between the solenoid drive output 128 of the power supply 126 and a field effect transistor "FET" 184 which serves as a switch. The gate or control input of FET 184 is connected via a resistor 186 to the output of inverter 176, and hence, to the output of gating and timing circuit 166. Solenoids 180 are physically mounted within housing 122 (FIG. 3) in proximity to the recess 124 in the housing surface. The solenoids are disposed within the housing so that when the housing 20 of a tag is inserted in recess 124, solenoids 180 will be adjacent the magnetic reed switch 102 (FIGS. 2 and 4) of the tag and so that magnetic fields from the solenoids will be imposed on the magnetic reed switch of the tag.

The circuit further includes a reset signal section 188 comprising a "one shot" or monostable multivibrator 190, incorporating a pair of gates and a timing capacitor. The input of one shot 190 is connected to the output of gating and timing circuit 166, whereas, the output of the one shot is connected to the base or control input of a transistor 192. Transistor 192 in turn is connected in series with a light-emitting diode 194 between a source of component voltage and ground.

In operation, after the monitoring officer has attached a tag to the person to be monitored, he resets it using tool 120. While the tag remains attached to the monitored person, the officer instructs the monitored person to place the tag within recess 124. At this point in the operation, the tamper latch 92 of the tag is still in its tamper state. The transmitter 44 of the tag is sending the tamper signals as described above, in three millisecond transmission intervals spaced apart by 35 second dwell intervals. When a transmission interval occurs, the RF signal from the tag impinges on the antenna 134 of receiver 132, generating a three millisecond negative polarity pulse at node 144. The leading edge of this pulse corresponds substantially to the beginning of the transmission interval. This pulse is transmitted as an amplified positive-polarity three millisecond pulse at the output 162 of amplifier 152. At the beginning of this positive-going pulse, the output from gate 168 goes from high to low, whereas, at the end of this pulse, the output from gate 168 goes from low to high. The first transition, from high to low, is delayed in passing to node 174 by the action of the slow attack circuit. Accordingly, there is a predetermined delay time between the inception of the pulse (the transition of gate output 168 from high to low) and the transition of the output from inverter 176 from low to high. This delay time is set by the characteristics of resistor 172 and capacitor 175, and preferably is about 1 millisecond. When the output from inverter 176 goes high, it switches FET 184 into a conducting mode, thus turning on solenoids 180. Thus, the magnetic flux from solenoids 180 starts about 1 millisecond after the commencement of the transmission interval. The magnetic field from solenoids 180 actuates switch 102 so as to disconnect the center terminal 104 from side terminal 108 and connect the center terminal to side terminal 100, and hence, to the reset input of flip-flop 92.

As pointed out above, the potential applied by switched power supply 48 goes from reference potential to high potential at the inception of each transmission interval. During the delay period (about 1 millisecond) between the inception of the transmission interval and the actuation of solenoids 180, magnetic switch 102 remains in the position illustrated in FIG. 4, so that center terminal 104, and hence, capacitor 106 remains connected to side terminal 108, and hence, to the output terminal 50 of the power supply. Accordingly, during this 1 millisecond delay, the high potential from the switched power supply 48 charges capacitor 106 to approximately the potential applied by the power supply. When solenoids 180 are actuated and switch 102 is thrown, this high potential from capacitor 106 is applied to the reset input 96 of flip-flop 92, thus resetting flip-flop 92 to its normal state. Once flip-flop 92 has been reset, the transmitter 44 will broadcast the normal tag signal bearing the normal or zero-value tamper bit.

At the end of the transmission interval, the negative going pulse at node 144 and the positive going pulse at output 162 terminate, whereupon the output of gate 168 goes high, and the output of inverter 176 immediately goes low, switching FET 184 into a nonconducting mode and terminating operation of solenoids 180. Thus, solenoids 180 are actuated for only a very brief interval, preferably about 2 milliseconds. When operation of solenoids 180 terminates, switch 102 returns to the position indicated in FIG. 4 and the resetting operation is terminated.

When the output from timing circuit 166 goes high so as to actuate solenoids 180, this high output is also applied to the input of one shot 190. The one shot 190 switches transistor 192 into conducting mode and retains it in conducting mode for a relatively long period, preferably about 6 seconds. During this time, LED 194 is illuminated. Upon observing illumination of LED 194, the officer knows that the tag has been reset. The officer can now dispatch the monitored person, with his tag in its normal condition, to his assigned monitoring location.

As will be appreciated from the foregoing description, the resetting tool provides a precise timing relationship between the transmitted tag signal sent by transmitter 44 and the resetting signal or magnetic fields applied by solenoids 180. In particular, the resetting signal or magnetic field is synchronized with the transmitted signal so that the resetting signal commences after lapse of a predetermined delay time following commencement of a transmission interval. This is necessary to operate switch 102 after capacitor 106 has charged, but before power supply 48 switches the potential at output 50 back to ground and discharges the capacitor. Switch 102 must be thrown at the correct time, within a margin of error of about 1 millisecond or less, relative to the commencement of a transmission interval. A monitored person observing the resetting operation may well surmise that the resetting operation is performed by some form of magnetic device. However, it will be almost impossible for the monitored person to achieve the required synchronization to reset the tag using an ordinary magnet or electromagnet without synchronization to the transmitted signal. This provides greatly enhanced security against unauthorized resetting. Moreover, this enhanced security is provided with an extremely simply tag structure and relatively simple resetting tool, so that the cost of the system remains within practical limits. The circuitry required in the resetting tool does not add appreciably to the overall cost of the system, because one resetting tool can serve many monitored persons.

As will be appreciated, numerous variations and combinations of the features discussed above can be utilized without departing from the present invention. For example, the precise nature of the normal and tamper signals is not critical. Although the normal and tamper signals discussed above are digitally encoded so as to differentiate one from the other, the normal signal and the tamper signal may differ from one another in other respects, as by having differing frequencies or amplitudes. Indeed, the resetting features discussed above can be applied to a tag which emits only a tamper signal and does not emit a normal signal. Such a tag may be employed where the normal signal is not required as an indication of the individual's presence. For example, commonly assigned U.S. Pat. No. 4,747,120 discloses a system utilizing a tag which does not normally emit radio signals. Such a tag may be modified to emit radio frequency tamper signals in the event of unauthorized removal from the monitored person and a resetting signal in accordance with the present invention may be used with a tag so equipped. Also, the normal and tag signals need not be radio frequency signals, but instead can be electrical, optical, or magnetic signals of other types. According to the broad compass of the invention, the resetting signal may be arranged to replicate a characteristic of the tamper signal other than its timing. For example, where the tamper tag signal bears a predetermined code, the resetting signal may be arranged to apply a corresponding code and the tag may be arranged to respond to resetting signals bearing only such a code. As such an encoded resetting signal would require a corresponding receiver and decoder in the tag, it is less preferred.

As these and other variations and combinations of the features discussed above may utilized without departing from the present invention, the foregoing description of the preferred embodiments should be taken by way of illustration rather than by way of limitation of the invention as defined by the claims.

What is claimed is:

1. A personnel monitoring tag comprising:

(a) tamper latch means having a normal state and a tamper state;

(b) tag signal means including means for sending a tamper tag signal having a predetermined characteristic when said tamper latch means is in said tamper state;

(c) securement means for securing said tag to a person to be monitored;

(d) tamper detect means for detecting detachment of said tag from said person to be monitored and pacing said tamper latch means in said tamper state in response to such detachment; and (e) reset means for resetting said tamper latch means to said normal state only in response to a reset signal replicating said predetermined characteristic of said tamper tag signal, whereby said reset means can be actuated only by receiving said tag signal so as to determine said predetermined characteristic thereof and producing a reset signal replicating such predetermined characteristic.

2. A tag as claimed in claim 1 wherein said tag signal means includes means for sending said tamper tag signal only during discrete transmission intervals, and wherein said reset means includes means for resetting said tamper latch means only in response to a reset signal bearing a predetermined time relationship with said transmission intervals of said tag signal.

3. A tag as claimed in claim 2 wherein said reset means includes means for resetting said tamper latch means only in response to a reset signal which commences during one of said transmission intervals of said tamper tag signal.

4. A tag as claimed in claim 3 wherein said tag signal means includes potential source means for providing a first potential during said transmission intervals and providing a second potential different from said first potential except during said intervals, a transmitter connected to said potential source means and operative to transmit said tamper tag signal in response to said first potential when said tamper latch means is in said tamper state, and wherein said reset means includes signal storage means for storing a first signal responsive to said first potential and a second signal responsive to said second potential, said reset means further including switch means for connecting said signal storage means to said potential source means except during application of said reset signal and disconnecting said signal storage means from said potential source means and connecting said signal storage means to said tamper latch means during application of said reset signal, said tamper latch means being settable to said normal state upon application of said first signal to said tamper latch means by said signal storage means, whereby said signal storage means will store said second signal except during said transmission intervals and will store said first signal only during said intervals, and said signal storage means will apply said first signal to said tamper latch means only if said reset signal commences during one of said transmission intervals.

5. A tag as claimed in claim 4 wherein said signal storage means includes a capacitor.

6. A tag as claimed in claim 4 wherein said switch means includes a magnetically actuatable switch.

7. In combination, a tag as claimed in claim 6 and a resetting tool including means for receiving said tamper tag signal and means for generating a magnetic field only while said tamper tag signal is being received.

8. In combination, a tag as claimed in claim 1 and a resetting tool including means for receiving said tamper tag signal, means for determining said predetermined characteristic of said tamper tag signal and means for generating said reset signal so that said reset signal matches said predetermined characteristic of said tamper tag signal and applying said reset signal to said tag.

9. A resetting tool for a personnel monitoring tag comprising means for receiving a tag signal from said personnel monitoring tag, means for determining a predetermined characteristic of said tag signal and means for generating a reset signal so that said reset signal matches a predetermined characteristic of said tag signal and applying said reset signal to the tag.

10. A tool as claimed in claim 9 wherein said means for determining a characteristic includes means for determining when said tag signal is being received and said means for generating a reset signal includes means for generating said reset signal in a predetermined time relationship to reception of said tag signal.

11. A tool as claimed in claim 10 wherein said means for generating said reset signal includes means for generating said reset signal only while said tag signal is being received.

12. A tool as claimed in claim wherein said means for generating said reset signal includes means for delaying commencement of said reset signal until a predetermined delay time has elapsed after reception of said tag signal has commenced.

13. A tool as claimed in claim 10 wherein said means for generating said tag signal includes means for generating a magnetic field and applying said magnetic field to the personnel monitoring tag.

14. A personnel monitoring tag comprising:

(a) tag signal means for sending a tag signal;

(b) reference means for providing a source of a reference potential;

(c) tamper latch means having a normal state and a tamper state, said tag signal means including means for sending a normal tag signal when said tamper latch means is in said normal state and a tamper tag signal when said tamper latch means is in said tamper state, said tamper latch means having a trip input and being responsive to change from said normal state to said tamper state upon application to said trip input of a trip potential different from said reference potential;

(d) securement means for securing said tag signal means to a person to be monitored;

(e) connection means for electrically connecting said trip input to said reference potential through said securement means so that said connection will be broken if said securement means is disrupted;

(f) alternating potential source means for providing a potential alternating between first and second potentials, at least one of said first and second potentials being different from said reference potential; and (g) a capacitor, said trip input of said tamper latch being connected to said alternating potential source means through said capacitor, whereby, if said connection through said securement means is broken, said alternating potential applied by said alternating potential source means will be applied to said trip input and said tamper latch will be set to said tamper state.

15. A tag as claimed in claim 14 wherein said connection means includes a first resistor connected between said trip input and said reference potential, said capacitor being connected to said trip input through said first resistor.

16. A tag as claimed in claim 15 further comprising DC source means for providing a substantially constant potential different from said reference potential and a second resistor having a resistance higher than said first resistor connected between said DC source means and said trip input.

17. A tag as claimed in claim 16 further comprising alternate path means for connecting said trip input to said DC source means through a path having an impedance lower than the resistance of said second resistor upon attempted disruption of said securement means.

18. A tag as claimed in claim 14 wherein said tag signal means includes a radio transmitter connected to said alternating potential source and responsive to one of said first and second potentials to send said tag signal, whereby said transmitter will send said tag signal intermittently.

19. A tag as claimed in claim 18 wherein said alternating potential source means is operative to apply said first potential only during predetermined intervals so that there are dwell periods between said intervals, said dwell periods being substantially longer than said intervals, said transmitter being responsive to said first potential to send said tag signal.

* * * * *

UNITED STATES PATENT AND TRADEMARK OFFICE

CERTIFICATE OF CORRECTION

PATENT NO. : 5,075,670

DATED : December 24, 1991

INVENTOR(S) : Bower et al.

It is certified that error appears in the above-identified patent and that said Letters Patent is hereby corrected as shown below:

Column 16, line 15, "pacing" should read -- placing --.
Column 17, line 31, after "claim" insert therefor -- 11 --.

Signed and Sealed this

Sixteenth Day of March, 1993

*Attest:*

STEPHEN G. KUNIN

*Attesting Officer*

*Acting Commissioner of Patents and Trademarks*